US007648674B2

(12) United States Patent
Charpientier et al.

(10) Patent No.: US 7,648,674 B2
(45) Date of Patent: Jan. 19, 2010

(54) DEVICE FOR THE IN-LINE TREATMENT OF LIQUID METAL BY MEANS OF GAS AND FILTRATION

(75) Inventors: Jacques Charpientier, Saint Julien de Ratz (FR); Jean-Marie Château, Saint Martin le Vinoux (FR)

(73) Assignee: Novelis Technology AG (CH)

( * ) Notice: Subject to any disclaimer, the term of this patent is extended or adjusted under 35 U.S.C. 154(b) by 360 days.

(21) Appl. No.: 10/514,165

(22) PCT Filed: May 6, 2003

(86) PCT No.: PCT/FR03/01399

§ 371 (c)(1),
(2), (4) Date: Nov. 12, 2004

(87) PCT Pub. No.: WO03/095686

PCT Pub. Date: Nov. 20, 2003

(65) Prior Publication Data

US 2005/0236746 A1 Oct. 27, 2005

(30) Foreign Application Priority Data

May 13, 2002 (FR) ..... 02 05867

(51) Int. Cl.
*C21C 7/00* (2006.01)

(52) U.S. Cl. ..... 266/217; 266/275

(58) Field of Classification Search ..... 266/47, 266/218, 217, 220, 265, 268, 275
See application file for complete search history.

(56) References Cited

U.S. PATENT DOCUMENTS 3,917,242 A * 11/1975 Bass et al. ..... 266/207
4,257,810 A 3/1981 Narumiya
4,390,364 A 6/1983 Yu
4,401,295 A 8/1983 Yoshida
4,515,630 A 5/1985 Tyler et al.
5,846,479 A * 12/1998 English ..... 266/47

FOREIGN PATENT DOCUMENTS

| | | |
|---|---|---|
| DE | 1941270 | 3/1971 |
| EP | 0291580 | 11/1988 |
| FR | 2039232 | 1/1971 |
| FR | 2200364 | 4/1974 |

(Continued)

*Primary Examiner*—Kevin P Kerns
(74) *Attorney, Agent, or Firm*—Connolly Bove Lodge & Hutz LLP

(57) ABSTRACT

A single treatment compartment has a liquid metal inlet and outlet and a connection to a liquid metal-input trough. A treatment gas is injected into the liquid metal arranged in at least one sidewall of a ladles. The liquid metal inlet and outlet have an orifice positioned so as to be entirely underneath a level of the liquid metal during the treatment, in order to prevent entry of ambient air into the compartment during treatment. The treatment compartment includes an upstream part and a downstream part. The gas injection is accomplished in the upstream part. The compartment further has a filter located in the downstream part for degassing and filtering the liquid metal. Injection and filtration occur in close proximity to one another and within the same single treatment compartment.

19 Claims, 5 Drawing Sheets

FOREIGN PATENT DOCUMENTS

| | | |
|---|---|---|
| FR | 2305407 | 10/1976 |
| FR | 2506785 | 12/1982 |
| FR | 2669041 | 5/1992 |
| GB | 1410898 | 10/1975 |
| GB | 1428146 | 3/1976 |

* cited by examiner

DEVICE FOR THE IN-LINE TREATMENT OF LIQUID METAL BY MEANS OF GAS AND FILTRATION

CROSS REFERENCE TO RELATED APPLICATIONS

This application is a 35 U.S.C. §371 national stage application of International Application No. PCT/FR03/01399 filed May 6, 2003, which in turn claims priority to French Application No. 02/05867 filed May 13, 2002.

BACKGROUND OF THE INVENTION

1. Domain Of the Invention

The invention relates to a device for treatment of a flow of liquid metal, particularly aluminium, an aluminium alloy, magnesium or a magnesium alloy.

2. State of the Art

Methods of treatment of a liquid metal flow or batch before it is cast in the form of a metallurgical product, such a shaped part, a billet or a plate, are known. Treatment of liquid metal is usually intended to eliminate dissolved gases (particularly hydrogen), dissolved impurities (particularly alkaline metals) and solid or liquid inclusions that could reduce the quality of cast products. This treatment typically includes a treatment operation by insufflation of a gas into the liquid metal, this operation being performed in a first ladle. The treatment gas may be inert and insoluble in the liquid metal (such as argon) or reactive (such as chlorine), or a mix of inert and insoluble gas. The inert and insoluble gas absorbs dissolved gas by the dilution effect and carries it with it. The reactive gas reacts with some dissolved impurities and thus generates liquid or solid inclusions which, like those already present in the liquid metal, can be eliminated by a filtration operation in a second ladle provided with a filter, such a deep bed filter.

Known treatment systems for liquid metals always have several disadvantages. In particular, known systems are voluminous installations, for which maintenance is usually complicated. Such systems require a high initial investment and introduce large operating costs.

U.S. Pat. No. 5,846,479 describes a system for inline treatment comprising a closed treatment compartment and a series of treatment gas injection nozzles arranged in line along the sides of the compartment. This system is incapable of eliminating solid inclusions.

The inventors have searched for a compact device for the treatment of liquid metals that provides an industrial and economic solution to disadvantages of devices according to prior art.

SUMMARY OF THE INVENTION

An object of the invention is a device for treatment of a liquid metal flow comprising a treatment ladle including fixed injection means located in the part upstream from the treatment ladle and at least one filtration means in its downstream part.

The inventors had the idea of grouping the treatment gas injection means and filtration means inside a compact treatment compartment. Grouping in this way considerably reduces the complexity of the liquid metal treatment system and facilitates maintenance. The inventors also had the idea that grouping these treatment means in the same compartment could lead to an improvement in the treatment, firstly due to the fact that mixing of the liquid metal due to insufflation of gas into this compartment prevents accumulation of solid materials close to the filtration means (particularly on the surface of the filtration slab(s) when these filtration means are used), and secondly the filtration means encourages the formation of liquid metal re-circulation flows inside the compartment that tend to increase the residence time and the treatment efficiency.

Another object of the invention is use of the said device for treatment of a liquid metal flow.

The said liquid metal is typically chosen from the group composed of aluminium, aluminium alloys, magnesium and magnesium alloys.

BRIEF DESCRIPTION OF THE DRAWINGS

The invention will be better understood with reference to FIGS. 1 to 8 that contain a diagrammatic representation illustrating advantageous embodiments, and the following detailed description.

DETAILED DESCRIPTION OF A PREFERRED EMBODIMENT

Figure 1:
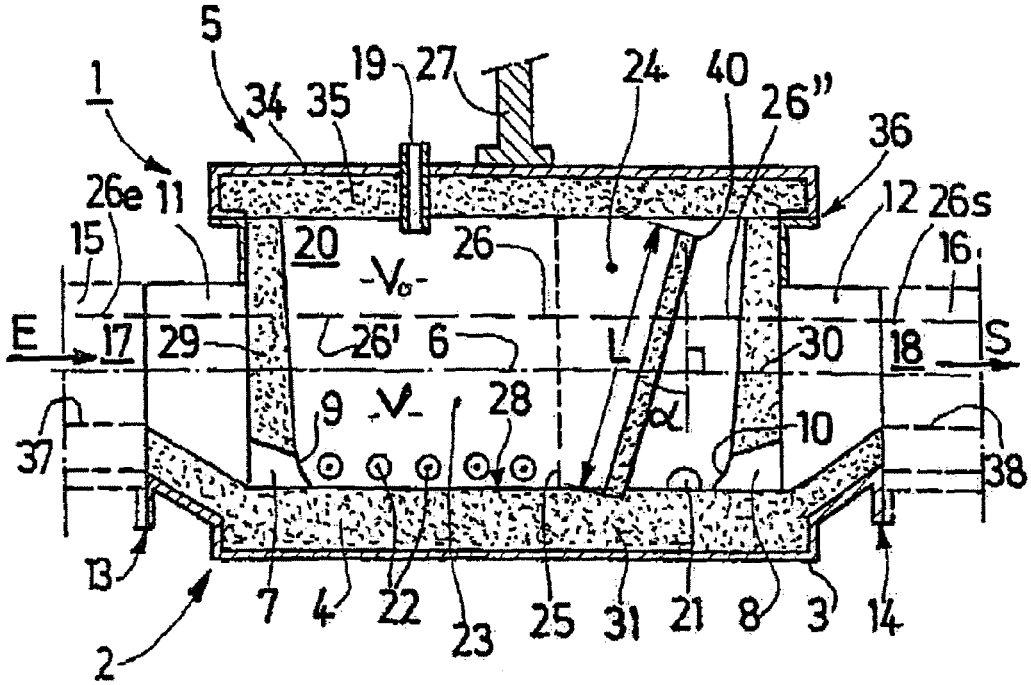
FIG. 1 illustrates a longitudinal section and a side view of an embodiment of the invention in which the device comprises a single filtration slab.

With reference to the figures, the device (1) for treatment of a liquid metal flow according to the invention comprises a treatment ladle (2) comprising a treatment compartment (20), liquid metal inlet means (7, 9) and outlet means (8, 10), connection means (11, 12, 13, 14) to at least one liquid metal input trough (15), and at least one liquid metal output trough (16), and means (22, 22*a*, 22*b*) of injecting a treatment gas into the liquid metal arranged in at least one sidewall (32, 33) of the ladle (2), the said liquid metal inlet and outlet means each comprising at least one orifice (9, 10) positioned so as to be entirely underneath the level (26) of the liquid metal during the treatment, in order to prevent the entry of ambient air into the compartment during the treatment, and is characterised in that the said treatment compartment (20) comprises an upstream part (23) and a downstream part (24), and in that the said injection means (22, 22*a*, 22*b*) are located in the said upstream part (23) and in that the said compartment (20) also comprises at least one first filtration means (40) located in the said downstream part (24).

The main longitudinal axis (6) of the device according to the invention is approximately horizontal during the treatment. The average liquid metal flow in the device according to the invention during the treatment is also essentially horizontal. The device according to the invention can thus be inserted in a liquid metal flow system from a support ladle to the intermediate casting device through open channels. The lack of any large level difference between the inlet and outlet of the device simplifies the liquid metal flow system and prevent risks of overflow of the liquid metal.

The theoretical free surface of the liquid metal during the treatment is materialised by a cross hatched line 26. Of course, the free surface of the liquid metal is generally not plane within the treatment compartment, in the sense that the gas bubbles provoke deformation of this surface during treatment. The level (26) of liquid metal is defined as being the average level of the free surface of the liquid metal that would be observed if there was no injection of treatment gas. The level (26) of liquid metal is typically approximately constant in the treatment compartment. In other words, the level (26') of liquid metal in the upstream part (23) of the said compartment is preferably typically approximately the same as the level (26") of liquid metal in the downstream part (24) of the said compartment.

The said liquid metal inlet means (7, 9) and outlet means (8, 10) are arranged such that during the treatment, the level (26*e*) of liquid metal at the device inlet is approximately the same as the level (26*s*) of liquid metal at the outlet from the device. The expression "approximately the same as the level" means that the level difference is less than about 1 cm.

The levels Ne and Ns of the bottoms (37, 38) of the input trough (15) and output trough (16) of the device according to the invention are typically approximately the same. The levels Ne and Ns are typically between 20 and 50% of the average depth H of the liquid metal contained in the treatment compartment during the treatment.

The orifices (9, 10) are preferably located near the bottom (28) of the said compartment in order to encourage a more efficient treatment of the liquid metal and to simplify draining of the treatment compartment. More precisely, the bottom of the inlet orifice (9) or outlet orifice (10) is preferably at a distance less than about 10 cm, and even more preferably less than about 5 cm, from the bottom (28) of the upstream part (23) of the treatment compartment (20).

In one preferred embodiment of the invention, the orifices (9, 10) typically correspond to an end of openings or channels (7, 8) arranged in the opposite end walls (29, 30) of the ladle (2). These orifices may possibly be formed by more complex arrangements, for example including a baffle.

The ladle (2) typically comprises a metal shell (3) and an inner lining (4) made of a refractory material. The lining (4) may be preformed.

In order to enable easy evacuation of residual metal between treatment operations, the ladle advantageously comprises at least one drain (21) that is preferably located near the bottom (28) of the ladle (2). The drain may be located on the upstream or downstream side of the said filtration slab(s) (40, 41). It may be advantageous to provide a drain in the upstream part (23) of the treatment compartment and in the downstream part (24) of the treatment compartment in order to completely drain the ladle after the treatment operation.

The bottom (28) may possibly be inclined from the main axis (6) of the device.

The ladle (2) is typically closed in its upper part, by means of a removable cover (5). The cover typically comprises a metal enclosure (34) and a refractory lining (35). The cover is advantageously provided with a gripping means (27) so that it can be put into place and removed easily, usually using mechanical means. The device (1) advantageously comprises sealing means to prevent gaseous exchanges between the inside and outside of the said compartment (20) such as a seal (36) between the cover (5) and the shell (3).

The treatment ladle (2) and/or the cover (5) may be provided with means (19) for evacuation of the treatment gas, such as a pipe made of a refractory material.

During use, the "untreated" liquid metal (17) enters into the treatment compartment (20) through the inlet orifice (9) while the "treated" metal (18) exits from the said compartment (20) through the outlet orifice (10). In the figures, the untreated metal enters at the left end (E) of the device and the treated metal exits at the right end (S) of the device.

As illustrated in FIGS. 1 to 8, the inlet orifice (9) and the outlet orifice (10) of the liquid metal are located on two opposite faces (29, 30) of the device. This configuration corresponds to a straight-line arrangement. According to the invention, it is also possible to arrange the inlet and/or outlet on other faces of the device, such that they may for example be perpendicular to or parallel to each other.

The injection means (22, 22*a*, 22*b*) are preferably located in at least one sidewall (32, 33) of the ladle (2). In other words, the injection means are advantageously placed on at least one of the sides of the treatment compartment (20) of the ladle (2), and more precisely in at least one of the sidewalls (32, 33) of the said compartment, the said sidewalls are essentially perpendicular to the liquid metal flow. This choice enables the use of several injection means along the metal flow, thus improving the treatment efficiency. The injection means (22, 22*a*, 22*b*) are typically placed in the two sidewalls (32, 33) of the treatment compartment (20).

Figure 6:
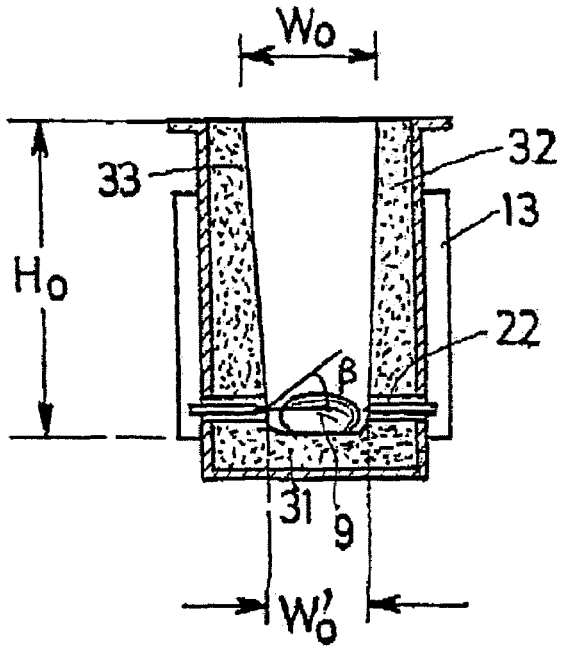
FIG. 6 illustrates a cross section through an embodiment of the invention in which the injection means are arranged at the bottom of the treatment compartment.

The injection means (22, 22*a*, 22*b*) are typically arranged in line and preferably located near the bottom (28) of the treatment compartment (20) to enable gas insufflation in the largest part of the volume of liquid metal included in the upstream part (23) of the said compartment. The height of the injection means relative to the bottom of the treatment compartment is typically between 2 and 6 cm. FIG. 6 corresponds to section A-A' in FIG. 5, and illustrates this preferred embodiment of the invention.

It is preferable according to the invention to provide injection means (22, 22*a*, 22*b*) only in the upstream part (23) of the treatment compartment (20). It is particularly advantageous to locate the injection means (22, 22*a*, 22*b*) in the liquid metal flow output from the inlet orifice (9), so as to increase the volume of liquid metal actually treated.

The injection means (22, 22*a*, 22*b*) are typically nozzles that may be fixed or adjustable in direction.

Figure 7:
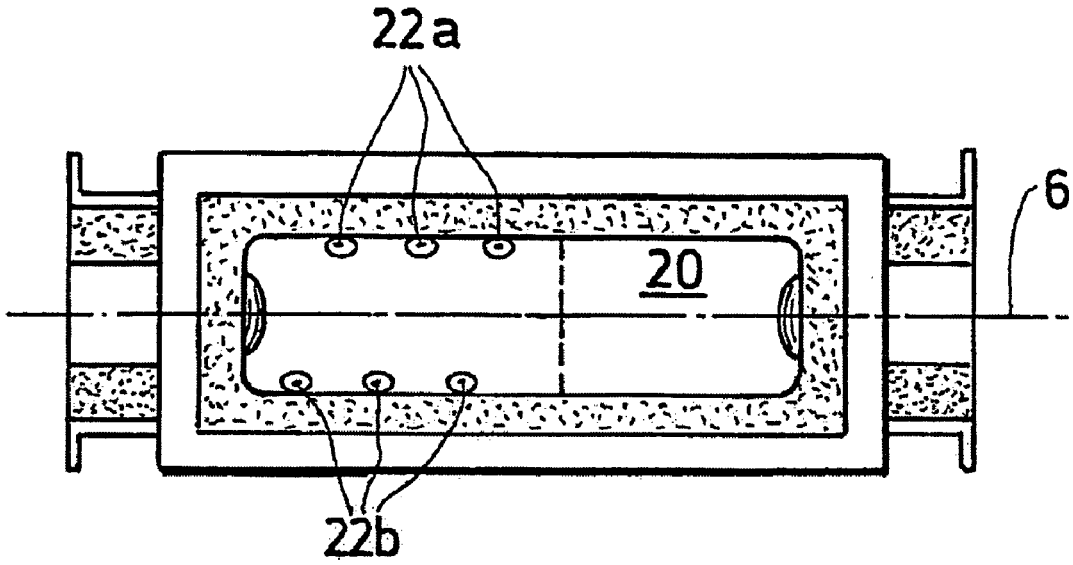
FIG. 7 illustrates a top view of an embodiment of the invention in which the injection means are arranged in line and alternating on each side of the treatment compartment.
Figure 8:
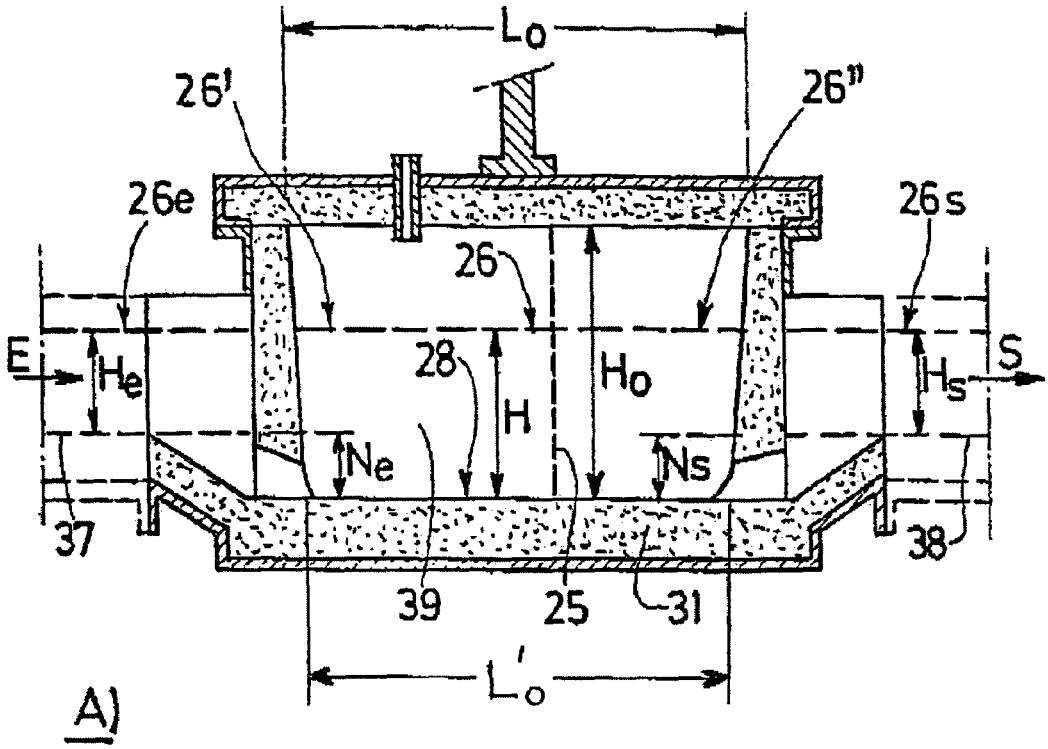
FIG. 8 shows the sizing parameters of the device according to the invention. He and Hs correspond to the normal heights of liquid metal in the input trough (15) and the output trough (16) respectively. Ne and Ns correspond to the height of the bottom (37, 38) of the input trough (15) and the output trough (16) respectively, above the bottom (28) of the treatment compartment (20). H is the normal average height of liquid metal in the treatment compartment (20). Ho is the average internal height of the treatment compartment (20).
Figure 8:
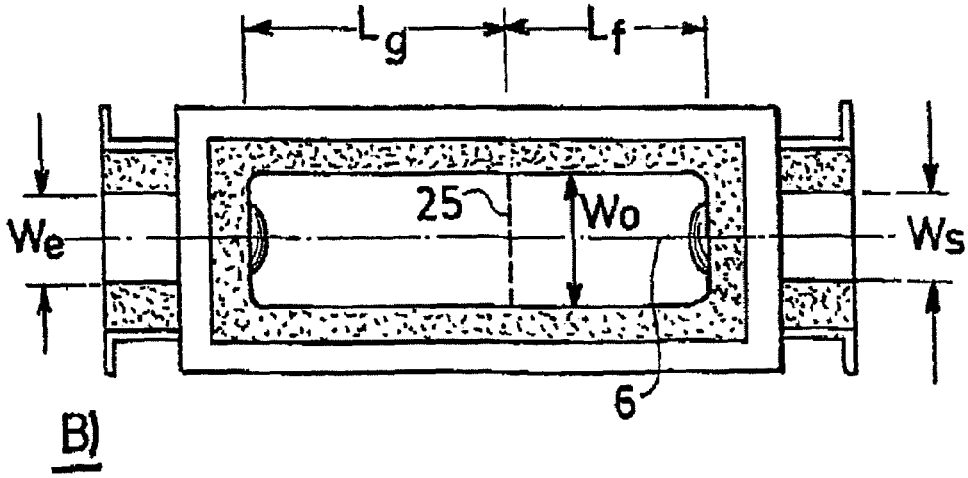

It is advantageous to place injection means (22, 22*a*, 22*b*) alternating in the two sidewalls (32, 33) of the treatment compartment (20), in other words on each side of the treatment compartment. The said means are then not facing each other, so that the gas jets do not strike each other directly. In this variant, one embodiment of which is illustrated in FIG. 7, the injection means (22*a*) that are placed along the said compartment (20) are offset longitudinally (in other words along the longitudinal direction of the device) from the injection means (22*b*) that are placed on the other side of the said compartment (20). This arrangement increases the treatment efficiency. In this configuration, the injection means are typically in line on each side of the treatment compartment.

The number of injection means is typically between 3 and 10 on each side of the said compartment. They are typically at a spacing of 10 to 20 cm.

The injection means (22, 22*a*, 22*b*) are preferably such that they do not form protuberances inside the treatment compartment, so as to enable easy maintenance of this compartment. When the injection means (22, 22*a*, 22*b*) are in the form of nozzles or similar systems, they may be arranged set back in the wall of the said compartment. The ends of the nozzles are preferably made from a refractory material, such as sialon (aluminium and silicon oxinitride).

The injection means (22, 22*a*, 22*b*) are normally fixed during the treatment, in the sense that they are not subjected to any displacement and/or rotation movement. However, their orientation may be variable to enable a finer adjustment of the injection efficiency of gas in the liquid metal.

The injection means (22, 22*a*, 22*b*) may possibly be used to inject the treatment gas with a particular orientation with respect to the bottom (28) of the said compartment. The treatment gas is typically injected at an angle β between 0° and 25° with respect to the bottom (28).

In order to obtain a compact and efficient treatment device, the injection means are preferably such that their total treatment gas flow from the injection means is typically more than about 5 $Nm^3$/hour (typically between 8 and 10 $m^3$/hour). This result can be obtained using a plurality of injection means preferably located near the bottom of the said compartment (typically at a distance of between 2 and 6 cm from the bottom).

The filtration means (40, 41) or each filtration means is placed in the downstream part inside the treatment compartment (20). It prevents inclusions from passing into the liquid metal flow (18) output from the device. Each filtration means (40, 41) is preferably a filtration slab to enable easy replacement of this means. The slab typically comprises a rigid ceramic foam such as CFF (ceramic foam filter) and is typically made of alumina. The porosity of the slab is preferably more than 10 ppi (pores per inch) (corresponding to 4 pores per cm) and is typically between 30 and 40 ppi (corresponding to 12 to 16 pores per cm), to enable easy priming of the filtration. The thickness of each slab is typically between 2 and 5 cm and its length L is typically between 30 and 50 cm.

In the embodiment of the invention illustrated in FIG. 1, the device comprises a single filtration slab (40) with a width typically equal to at least the width Wo of the said compartment and the length L is typically equal to at least the height H of the liquid metal in the said compartment. In order to limit overflows of unfiltered liquid metal above the filtration slab (40), the length L of the liquid slab is typically such that it extends almost as far as the cover (and therefore approximately equal to the height Ho of the internal cavity of the compartment (20)). The filtration slabs may be held in place by grooves formed in the wall of the treatment compartment.

Figure 2:
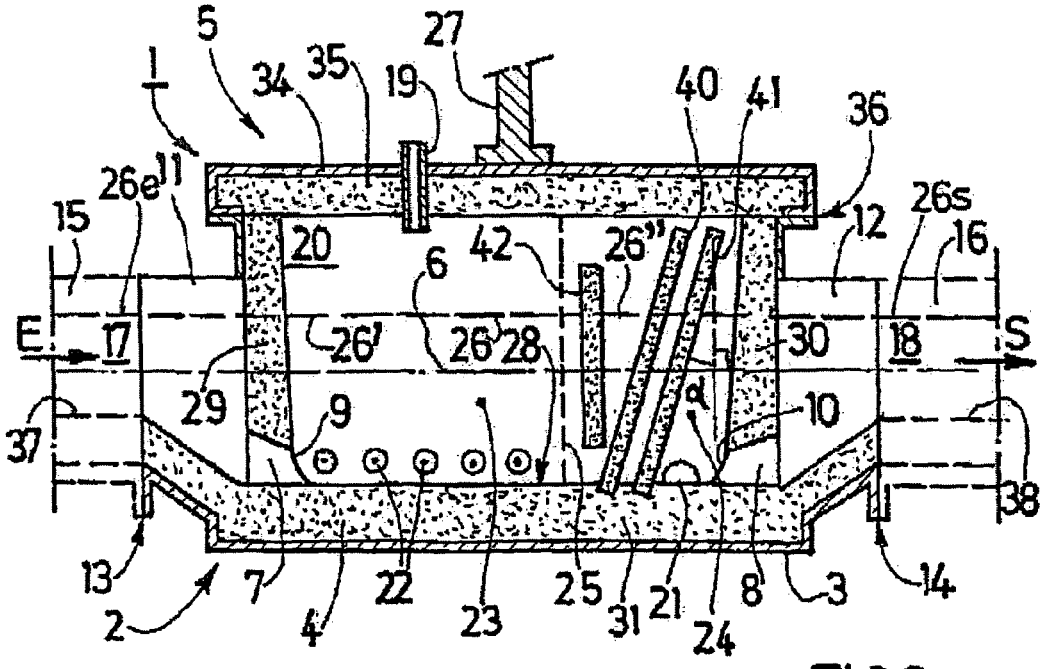
FIG. 2 illustrates a longitudinal section and a side view of an embodiment of the invention in which the device comprises a baffle and two filtration slabs.

In the embodiment of the invention shown in FIG. 2, the device comprises at least one second filtration slab (41) arranged on the downstream side of the first slab (40) (in other words the slabs (40, 41) are then arranged in series). These slabs are approximately parallel to each other. This variant of the invention makes it possible to change a slab without interrupting the treatment.

Figure 3:
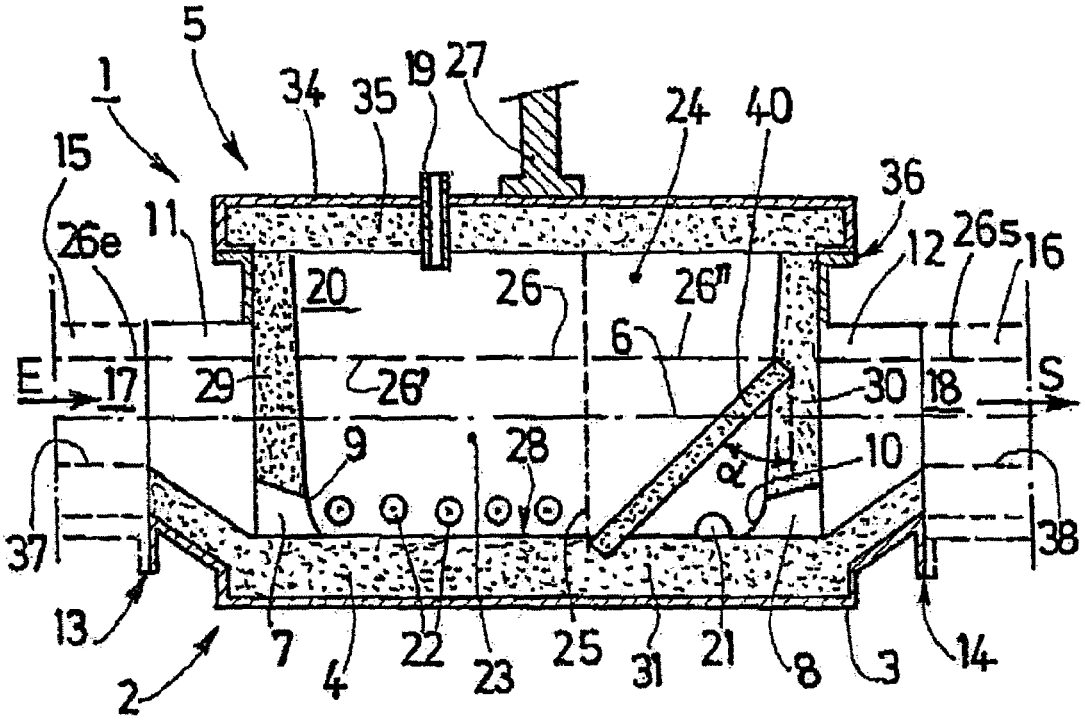
FIG. 3 illustrates a longitudinal section and a side view of an embodiment of the invention in which the device comprises a single filtration slab.

In the embodiment of the invention illustrated in FIG. 3, the filtration slab (40) is arranged so as to be located entirely in the liquid metal during the treatment, which means that the entire surface of the slab can be used for filtration.

Figure 4:
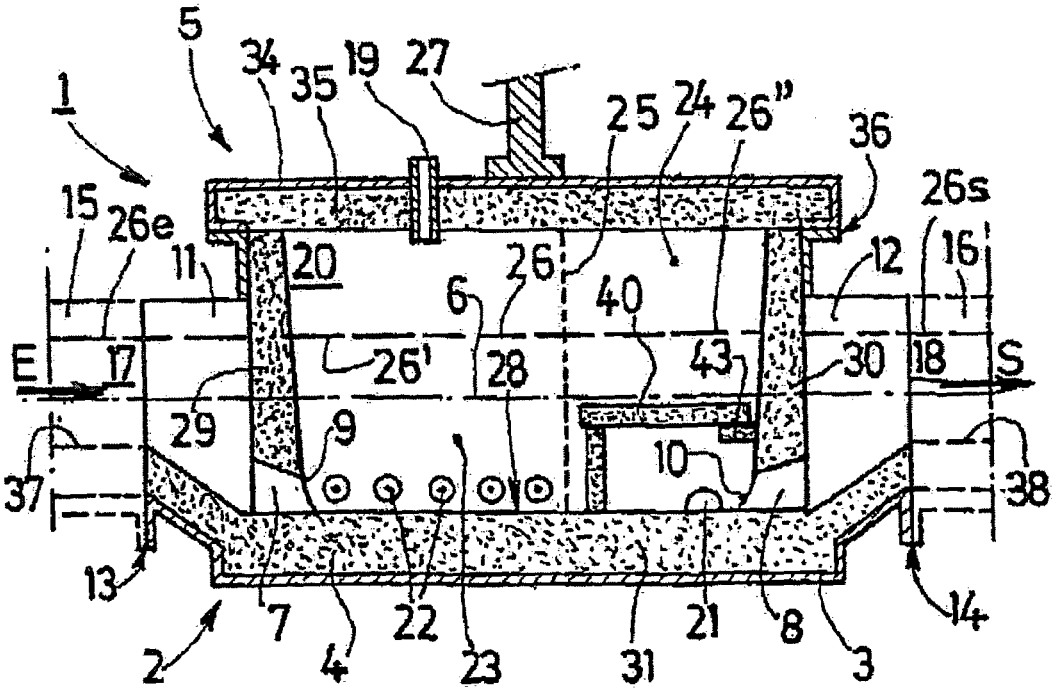
FIG. 4 illustrates a longitudinal section and a side view of an embodiment of the invention in which the device comprises a single filtration slab.
Figure 5:
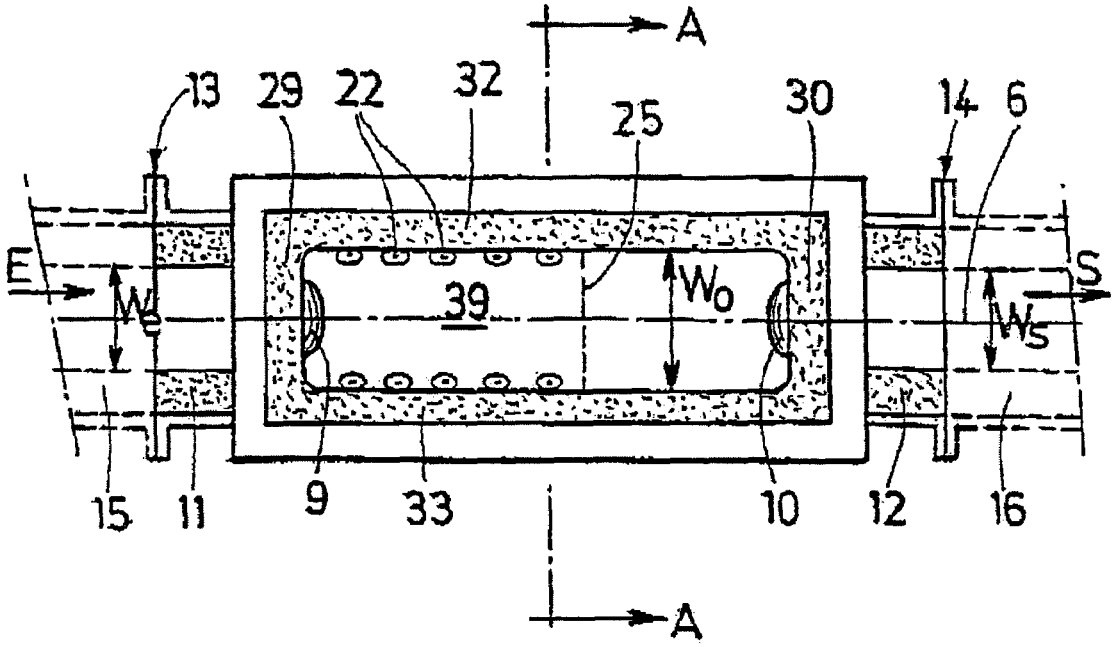
FIG. 5 illustrates a top view of an embodiment of the invention in which the means are arranged in line.

Each filtration slab (40) may be inclined by an angle a from the vertical (in other words from the vertical line perpendicular to the main axis (6) of the device in the compartment) in order to increase the filtration area and the metal flow. The angle α is typically between 20° and 90°. As illustrated in FIG. 4, the slab may possibly be arranged horizontal (in this case the angle α is equal to 90°).

The device according to the invention may also include a baffle (42) between the upstream part (23) of the said compartment (20) and the first filtration means (40), so as to limit turbulences close to the surface of the said filtration means (40), as illustrated in FIG. 1.

The filtration means are easy to replace in all these different variants.

The dividing line (25) between the gas injection liquid metal treatment area (23) on the upstream side, and the filtration metal treatment area (24) on the downstream side, is approximate. Of course, the gas injection treatment may extend slightly beyond this line. The length Lg of the upstream part (23) of the treatment compartment (20) is typically equal to 30% to 90%, and preferably 50 to 80% of the internal length Lo of the said compartment. The length Lf of the downstream part (24) of the treatment compartment (20) then is typically equal to 20 to 50% of the length Lo of the said compartment.

Compared with installations that include a filtration ladle at the output from the degassing treatment tank, the invention has the advantage that it reduces the length of troughs and reduces metal exposure to ambient air that in particular can result in reabsorption of hydrogen. Furthermore, the treatment device is warmed up in a single operation, in other words it is no longer necessary to warm up a gas treatment ladle and a filtration ladle separately, and this reduces costs (in particular, a single burner can be used for this operation). Operating costs can also be reduced because lining changes are only necessary in a single treatment device.

The device according to the invention may be opened during the treatment, without interrupting the treatment, in order to remove slag accumulated on the liquid metal surface and/or to replace a filtration slab.

With reference to the figures, typical dimensions of the device according to the invention are as follows:

- the height Ho of the treatment compartment is between 0.3 and 0.6 m;
- the length Lo of the said compartment in its upper part is between 0.8 and 1.0 m (the length Lo' in the lower part of the compartment is typically 10 to 20 cm smaller);
- the width Wo of the said compartment in the top part is between 0.2 and 0.4 m (width Wo' in the bottom part of the said compartment is typically 10 to 20 cm smaller);
- the average height H of the liquid metal inside the said compartment is between 0.2 and 0.5 m;
- the level Ns of the bottom (37) of the input trough and level Ne of the bottom (38) of the output trough are between 10 and 30 cm, above the bottom (28) of the treatment compartment;
- the width We of the input trough and the width Ws of the output trough are between 0.2 and 0.4 m.

The inside volume of the treatment compartment Vo may be very small in comparison with known degassing treatment devices including a ladle (the volume Vo of the device according to the invention is typically between 0.1 $m^3$ and 0.2 $m^3$ while the internal volume of known devices is typically between 0.5 and 1 $m^3$). The inventors consider that due to the use of high flow injection means and at least one filtration slab in the same compartment, the device according to the invention is capable of treating a volume V of liquid metal as low as 0.1 $m^3$ to 0.2 $m^3$ with a flow of more than 30 tonnes/hour, with a high efficiency (typically more than 40%).

The compactness of the treatment compartment (20) and the high flow of the device according to the invention ensure that the liquid metal does not cool during treatment.

LIST OF NUMERIC REFERENCES

1 Treatment device
2 Treatment ladle
3 Shell
4 Shell refractory lining
5 Cover
6 Main centre line of the device
7 Liquid metal inlet means
8 Liquid metal outlet means
9 Input orifice
10 Output orifice
11, 13 Means of connection to a input trough
12, 14 Means of connection to an output trough
15 Input trough
16 Output trough
17 Untreated liquid metal
18 Treated liquid metal
19 Treatment gas evacuation means
20 Treatment compartment
21 Drain
22, 22*a*, 22*b* Injection means
23 Upstream part of the treatment compartment
24 Downstream part of the treatment compartment
25 Approximate dividing line between the upstream and downstream parts
26 Theoretical free surface of liquid metal
26' Liquid metal level in the upstream part of the treatment compartment
26" Liquid metal level in the downstream part of the treatment compartment
26*e* Liquid metal level at the device inlet
26*s* Liquid metal level at the device outlet
27 Cover gripping means
28 Bottom of treatment compartment
29, 30 End walls of the treatment ladle
31 Bottom wall of the treatment ladle
32, 33 Sidewalls of the treatment ladle
34 Cover metal enclosure
35 Cover refractory lining
36 Seal between the cover and the shell
37 Bottom of the input trough
38 Bottom of the output trough
39 Gas treatment volume
40 First filtration means
41 Second filtration means
42 Baffle
43 Support means

The invention claimed is:

1. A device for treatment of a liquid metal flow comprising a treatment ladle, said ladle comprising:

a single treatment compartment, liquid metal inlet means and outlet means, connection means to at least one liquid metal input trough, at least one liquid metal output trough, and means for injecting a treatment gas into the liquid metal arranged in at least one sidewall of a ladle, wherein said liquid metal inlet and outlet means each comprise at least one orifice positioned so as to be entirely underneath a level of the liquid metal during the treatment, in order to prevent entry of ambient air into said compartment during treatment, and further wherein said treatment compartment comprises an upstream part and a downstream part, and said injection means is located in said upstream part, and wherein said compartment further comprises at least one first filtration means located in said downstream part for degassing and filtering the liquid metal;

said injecting and filtration means being located in close proximity to one another and within the same single treatment compartment.

2. A treatment device according to claim 1, wherein said orifices are located near a bottom portion of said compartment.

3. A treatment device according to claim 1, wherein the liquid metal inlet orifice and outlet orifice are arranged in opposite end walls of the ladle.

4. A treatment device according to claim 1 wherein the injection means are located near a bottom portion of the treatment compartment.

5. A treatment device according to claim 1, wherein the injection means are arranged in line.

6. A treatment device according to claim 1 wherein the injection means are arranged in two sidewalls of the treatment compartment.

7. A treatment device according to claim 6, wherein the injection means are alternating on each of said sidewalls of the treatment compartment.

8. A treatment device according to claim 1, wherein the injection means comprise nozzles.

9. A treatment device according to claim 1, wherein the injection means are adjustable in direction.

10. A treatment device according to claim 1, wherein the first filtration means comprises a filtration slab.

11. A treatment device according to claim 10, wherein the slab comprises rigid ceramic foam.

12. A treatment device according to claim 11, wherein the porosity of the rigid ceramic foam is at least 4 pores per cm.

13. A treatment device according to claim 10, wherein said device comprises at least one second filtration slab arranged on a downstream side of the first slab.

14. A treatment device according to claim 13, wherein each slab forms a single angle $\alpha$from a perpendicular to a main axis of said compartment and said angle is between 20° and 90°.

15. A treatment device according to claim 1, wherein said device further comprises a baffle between an upstream part of said compartment and the first filtration means, so as to limit turbulences close to a surface of said filtration means.

16. A treatment device according to claim 1, wherein a length (Lg) of an upstream part of the treatment compartment is equal to 30% to 90% of an internal length (Lo) of said compartment.

17. A treatment device according to claim 1, wherein a length (Lg) of an upstream part of the treatment compartment is equal to 50 to 80% of an internal length (Lo) of said compartment.

18. A treatment device according to claim 2, wherein the liquid metal inlet orifice and outlet orifice are arranged in opposite end walls of the ladle.

19. A treatment device according to claim 2, wherein the injection means are alternating on each of said sidewalls of the treatment compartment.

* * * * *

UNITED STATES PATENT AND TRADEMARK OFFICE

CERTIFICATE OF CORRECTION

PATENT NO. : 7,648,674 B2
APPLICATION NO. : 10/514165
DATED : January 19, 2010
INVENTOR(S) : Jacques Charpentier et al.

It is certified that error appears in the above-identified patent and that said Letters Patent is hereby corrected as shown below:

On the Title Page: Item (73) Assignee: Novelis Technology AG (CH) should read -- (73) Assignee: Novelis Inc. (CA) --.

Signed and Sealed this
Tenth Day of April, 2012

David J. Kappos

David J. Kappos
*Director of the United States Patent and Trademark Office*